US005563582A

United States Patent [19]

D'Hont

[11] Patent Number: 5,563,582

[45] Date of Patent: Oct. 8, 1996

[54] INTEGRATED AIR COIL AND CAPACITOR AND METHOD OF MAKING THE SAME

[75] Inventor: Loek J. D'Hont, Almelo, Netherlands

[73] Assignee: Texas Instruments Incorporated, Dallas, Tex.

[21] Appl. No.: 330,751

[22] Filed: Oct. 28, 1994

[51] Int. Cl.[6] ..... G08B 13/14

[52] U.S. Cl. ..... 340/572; 343/895

[58] Field of Search ..... 340/572; 342/42, 342/44, 51; 29/592.1, 825; 343/895, 866

[56] References Cited

U.S. PATENT DOCUMENTS

| | | | |
|---|---|---|---|
| 3,757,344 | 9/1973 | Pereda | 343/770 |
| 4,316,180 | 2/1982 | LeVert | 343/894 X |
| 4,475,108 | 10/1984 | Moser | 343/700 MS |
| 4,778,552 | 10/1988 | Benge et al. | 340/572 X |
| 4,857,893 | 8/1989 | Carroll | 340/572 |
| 5,053,774 | 10/1991 | Schuermann et al. | 342/44 |
| 5,307,081 | 4/1994 | Harmuth | 343/866 X |

FOREIGN PATENT DOCUMENTS

| | | | |
|---|---|---|---|
| 136265 | 4/1985 | European Pat. Off. | 340/572 |
| 2663145 | 12/1991 | France | 340/572 |

*Primary Examiner*—Thomas Mullen

*Attorney, Agent, or Firm*—Ira S. Matsil; James C. Kesterson; Richard L. Donaldson

[57] ABSTRACT

In one aspect, the present invention provides an integrated inductor and capacitor 20 which can be used as the inductive portion of a resonant circuit and the energy accumulator for a identification system transponder. In a first embodiment, the integrated inductor and capacitor component 20 may include first and second strips of electrically conductive material 22 and 26, for example aluminum. The first and second strips 22 and 26 are wound in a coil 20 to form a plurality of windings. Each winding is electrically insulated from adjacent ones of the windings by insulators 24 and 28. The component can be bonded to a transponder chip.

18 Claims, 5 Drawing Sheets

FIG. 1
(PRIOR ART)
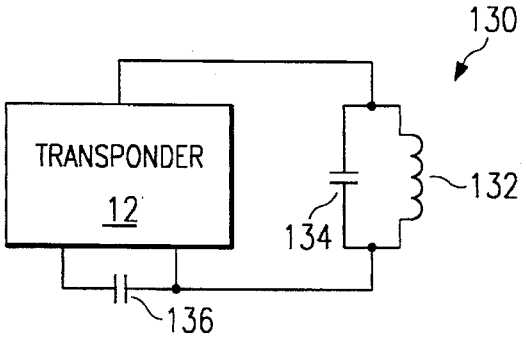
FIG. 2
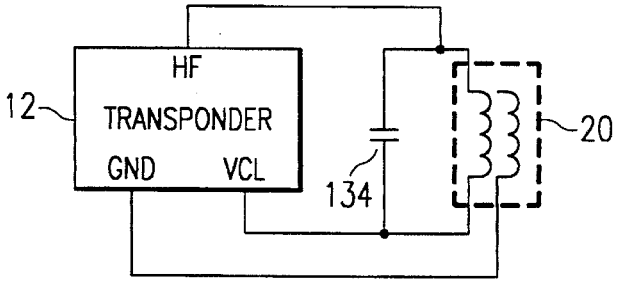
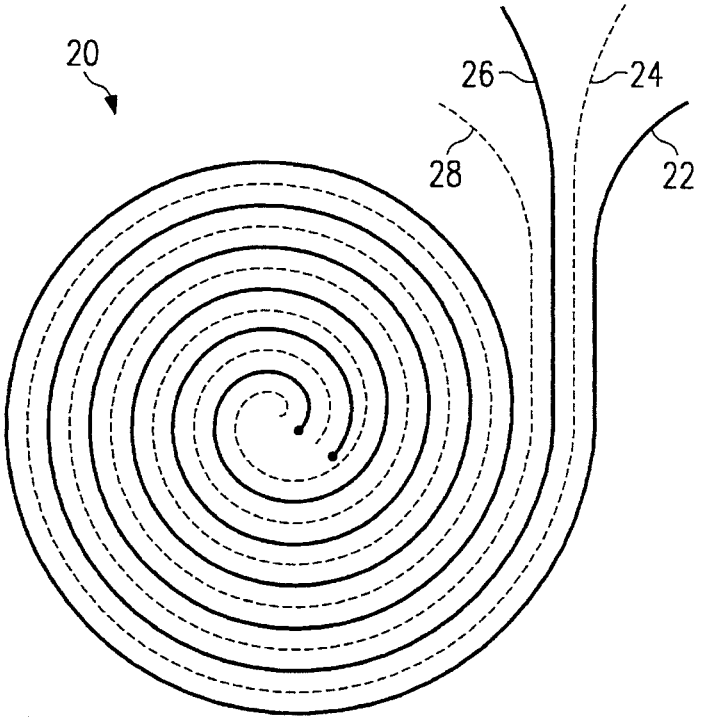
FIG. 3A

INTEGRATED AIR COIL AND CAPACITOR AND METHOD OF MAKING THE SAME

CROSS-REFERENCE TO RELATED APPLICATIONS

The following U.S. patent and commonly assigned applications are hereby incorporated herein by reference:

| Patent or Ser. No. | Filing Date | Effective Issue Date | TI Case No. |
|---|---|---|---|
| 5,053,774 | 07/08/88 | 10/01/91 | TI-12797A |
| 5,450,088 | 11/25/92 | 9/12/95 | TI-16688 |
| 5,408,243 | 01/14/93 | 4/18/95 | TI-16561 |
| 5,471,212 | 04/26/94 | 11/28/95 | TI-18205 |
| 08/330,038 | 10/27/94 | | TI-16816 |

FIELD OF THE INVENTION

This invention generally relates to identification systems and more specifically to an air coil antenna and a method for making the same.

BACKGROUND OF THE INVENTION

There is a great need for devices or apparatuses which make it possible to identify or detect objects over a certain distance without making contact. In addition, a need exists to be able to change the data stored in, or operating characteristics of, these devices or apparatuses (e.g., "program" the devices or apparatuses).

It is, for example, desirable to request, over a certain distance, identifications which are uniquely assigned to an object. These identifications could be stored in the device or apparatus so that, for example, the object may be identified. A determination may also be made as to whether or not a particular object exists within a given reading range.

As another example, physical parameters such as temperature or pressure can be interrogated directly even when direct contact to the object is not possible. A device or apparatus of the type desired can, for example, be attached to an animal which can then always be identified at an interrogation point without direct contact.

There is also a need for a device which, when carried by a person, permits access checking whereby only persons whose responder unit returns certain identification data to the interrogation unit are allowed access to a specific area. In this case the safeguarding of the data transfer is a very essential factor in the production of such devices.

A further example of a case in which such a device is needed is the computer controlled industrial production in which, without the intervention of operating personnel, components are taken from a store, transported to a production location and there assembled to give a finished product. In this case a device is required which can be attached to the individual components so that the components can be specifically detected in the spares store and taken therefrom.

Several transponder arrangements have been developed. One such transponder arrangement is described in U.S. Pat. No. 5,053,774 ('774) issued on Oct. 1, 1991, incorporated herein by reference. This patent describes a transponder unit which has a low energy requirement and does not need its own power source.

A transponder (or responder) 12 which may be used in the system of the '774 patent is schematically illustrated in FIG. 1. (The reference numerals of FIG. 1 have been chosen to correspond with FIG. 2 of the '774 patent.) The transponder unit 12 is coupled to a parallel resonant circuit 130 having a coil 132 and a capacitor 134 for reception of an interrogation pulse from a reader (not illustrated herein). Connected to the parallel resonant circuit 130 is a capacitor 136 which serves as an energy accumulator.

In typical embodiments, the transponder 12, capacitor 134, coil 132 and energy accumulator 136 are separate components which are then interconnected in a hybrid fashion. To reduce costs and lower size, however, it would be desirable to reduce the total number of components and integrate as many components as possible.

SUMMARY OF THE INVENTION

In one aspect, the present invention provides an integrated inductor and capacitor which can be used, for example, as the coil and energy accumulator for a transponder as in the '774 patent. The component also can be used in other systems such as the ones described in U.S. Pat. No. 5,450,088 or U.S. Pat. No. 5,471,212, both of which are incorporated herein by reference. In a first embodiment, the integrated inductor and capacitor component may include first and second strips of electrically conductive material, for example aluminum. The first and second strips are wound in a coil to form a plurality of windings. Each winding is electrically insulated from adjacent ones of the windings.

The present invention provides a number of advantages. For example, it is always desirable to provide low cost components which can be manufactured inexpensively. The present invention provides an integrated inductor/capacitor component which can fabricated at relatively low costs. In addition, since the component can be formed using aluminum, a low weight can be achieved. Aluminum characteristically has very good electrical performance per mass. Each of these advantages can be achieved while still maintaining the high performance such as may be required in identification systems.

To minimize the costs, the integrated inductor and capacitor can be bonded directly to a transponder chip thus eliminating one of the components. In addition, the resonant capacitor can be implemented on the transponder chip thereby eliminating the need for yet another component. Since only two components need to be bonded, there is no need for a printed circuit board which is used for prior art applications. Therefore, the present invention provides the advantage of a lower component count and is thus less expensive.

Other advantages also exist with the present invention. The invention has a shorter production cycle then prior art processes and is thus less expensive. In addition, the resultant transponder is lighter while maintaining high performance. Transponders built with the concepts of the present invention are also real suitable for mass-production thereby opening the road to the throw-away applications since transponders could be built inexpensively enough to be disposable.

In addition, prior art methods of manufacturing transponders needed to include a coil-to-COB (chip on board) connection step. In this prior art process, the transponder chip must be bonded (e.g., using silver epoxy) to a carrier. The other external components, namely the capacitor and inductor, would also be bonded. Bonding the inductor to the carrier is particularly troublesome. The antenna (inductor) wire first needs to be stripped from its insulation which requires a cumbersome process such as micro-sand blasting or inert-gas heating. These steps are eliminated in the present invention because the chip can be glued to the side of the coil. Then, one could use bond techniques to bond the three chip contacts (four in the case where a charge pump is used) to the coil terminals. These steps require only aluminum (the chip bond pad) to aluminum (the aluminum foil from the coil) bonding which can be accomplished using standard processes.

BRIEF DESCRIPTION OF THE DRAWINGS

The above features of the present invention will be more clearly understood from consideration of the following descriptions in connection with accompanying drawings in which:

FIG. 1 illustrates a schematic drawing of a prior art transponder;

FIG. 2 illustrates a schematic drawing of a preferred embodiment transponder circuit;

FIGS. 3A–C illustrate a preferred embodiment coil;

Corresponding numerals and symbols in the different figures refer to corresponding parts unless otherwise indicated.

DETAILED DESCRIPTION OF PREFERRED EMBODIMENTS

Figure 3B:
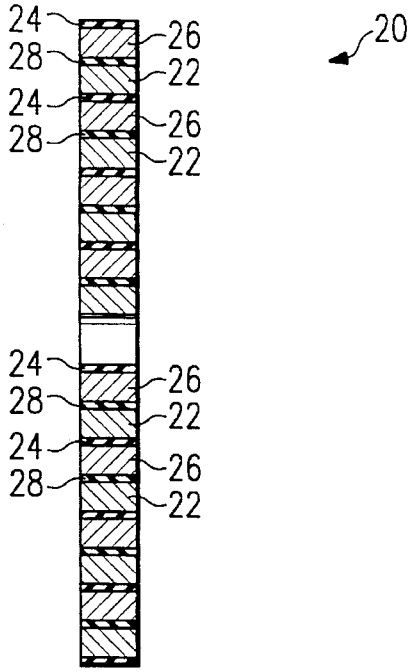
Figure 3C:
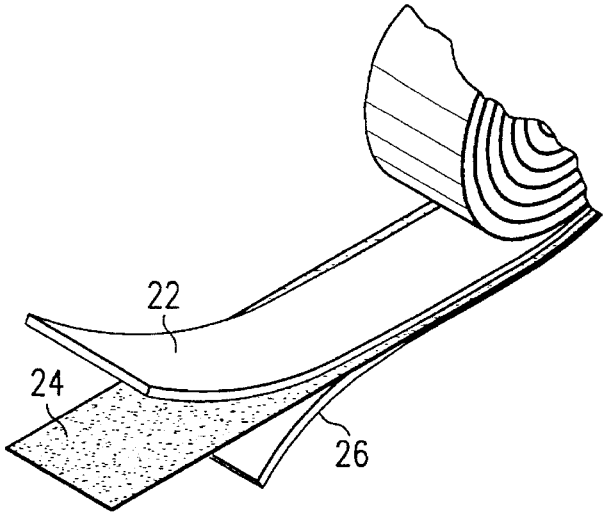

The making and use of the presently preferred embodiments are discussed below in detail. However, it should be appreciated that the present invention provides many applicable inventive concepts which can be embodied in a wide variety of specific contexts. The specific embodiments discussed are merely illustrative of specific ways to make and use the invention, and do not limit the scope of the invention.

The following is a description of the transponder of the present invention. The structure of the integrated capacitor/inductor component will first be described followed by some of the advantages it affords. A method of forming the component will then be described.

Referring first to FIG. 2, a schematic diagram of a transponder of the present invention is illustrated. The transponder chip 12 may be one as described in U.S. Pat. No. 5,053,774, incorporated herein by reference. In addition, the present invention may be utilized with the transponder 12 as described in co-pending application Ser. No. 07/981,635, now U.S. Pat. No. 5,450,088.

As in the prior art system of FIG. 1, the transponder 12 has a resonant circuit 130, including coil 132 and capacitor 134, and an energy accumulator 136 coupled to it. In this embodiment, however, the energy accumulator 136 and coil 132 have been integrated into a single component—inductor/capacitor component 20.

The capacitor 134 of resonant circuit 130 may comprise a discrete capacitor 134 which is bonded (or otherwise physically attached and electrically coupled) to transponder chip 12, or preferably an on-chip integrated circuit capacitor formed along with the internal transponder circuitry.

In the preferred embodiment of the present invention, the transponder coil 20 is made from two layers of conductive material 22 and 26 such as aluminum foil. Each layer of conductive material 22 and 26 has a thin insulation layer 24 or 28 adjacent it. The layers rolled up to form the windings of a coil. In this manner, the coil 20 also forms the energy accumulator or charge capacitor 136.

Figure 6:
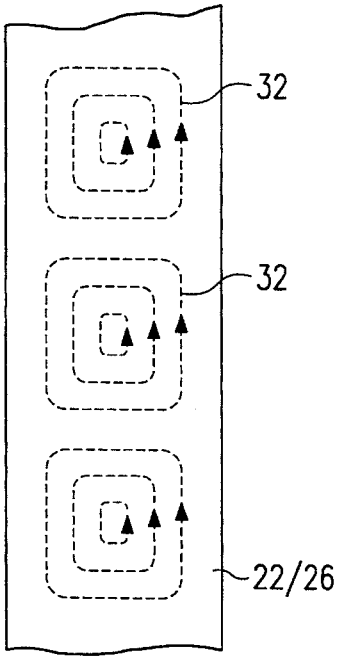
FIG. 6 illustrates a foil strip in which eddy currents are generated.

As will be described below with respect to FIG. 6, the foil 22/26 can have laser cuts in length direction to lower eddy current losses and thus allowing an even higher antenna Q (quality factor).

Figure 4:
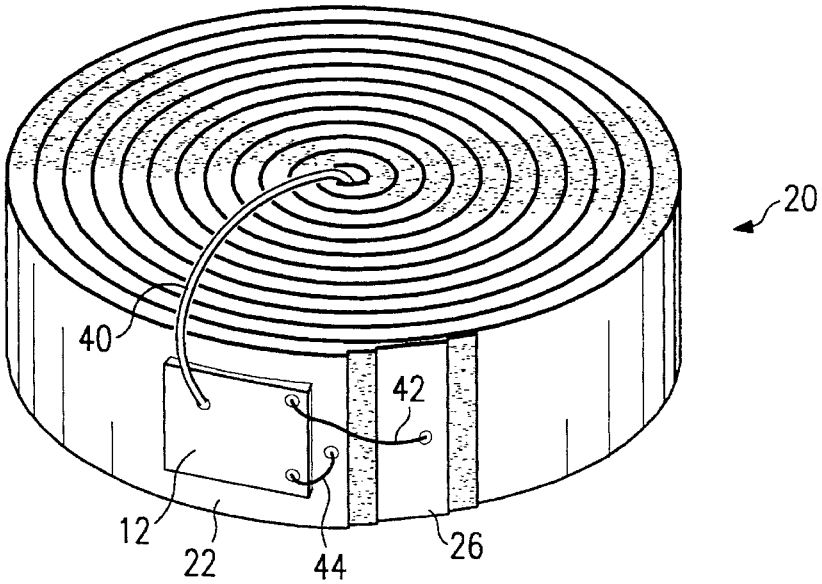
FIG. 4 illustrates a transponder bonded to a coil.

When using a transponder chip 12 with the resonance capacitor 134 (e.g., 470 pF) already integrated in the chip circuitry, the transponder chip 12 could be directly bonded onto the aluminum coil 20 on the side of the tape-wound aluminum-foil coil (see FIG. 4, for example). Thus, the component count can be lowered to only two individually fabricated components. This configuration eliminates a number of components which are necessary for prior art transponders, namely, a printed-circuit board (normally used for chip-on-board or COB), a charge capacitor (which is now part of the coil), and a resonance capacitor (which is on-chip). Lower costs can be achieved when less components are being used.

In the preferred embodiment illustrated in FIG. 2, the coil 20 has three connections: high frequency (HF), supply-voltage ($V_{CL}$), and ground (GND). The configuration is suitable for the transponder arrangement described in the '774 patent.

In alternate embodiments other connections are possible. Since the coil exists of two parallel coils with a DC offset of the transponder $V_{CL}$ voltage, the coils also can be used as a voltage step-up transformer. This feature can make a more effective charge-pump for read-write type of transponders such as the one described in the U.S. Pat. No. 5,450,088. In this case, four coil connections would be needed: HF, $V_{CL}$ on one side, and $RF_1$ and $RF_2$ on the other side.

In this case the component functions as a transformer. The $V_{CL}$ voltage (that exists between the primary and secondary windings) would be the extra voltage "lift" that the system gets for free rather than generating it by means of the charge pump function. In the standard charge pump, this is not the case. In that case, all the voltage increase needs to come from a "diode-capacitor" ladder. This ladder can be shorter and simpler. Also, the charge pump can not operate above 60° C. With a shorter ladder, this problem will be less severe.

A first embodiment inductor/capacitor component 20 is illustrated in FIGS. 3*a* and 3*b*. The component 20 comprises a first strip of electrically conductive material 22, a first insulating material 24, a second strip of electrically conductive material 26, and a second insulating material 28. The first and second strips 22 and 26 are wound in a coil to form a plurality of windings. The insulating material layers 24 and 28 electrically insulate each of the windings from adjacent ones of the windings.

In the preferred embodiment, the electrically conductive strips 22 and 26 are strips of aluminum. Alternatively, other materials such as copper, silver, gold, platinum, magnesium or titanium can be used. In fact, any conductive, non-magnetic material (e.g., any non-ferro metal) can be used. Since aluminum is three times lighter (in the same volume)

as copper while having only 25% less conductivity (in the same volume), a transponder using aluminum would be much lighter although slightly inferior electrically. Also, aluminum is much less expensive than copper on the commodity-market. Therefore, a design tradeoff must be made with regard to which material to use.

The insulating material 24 and 28 may comprise any thin insulation foil such as mylar or polystyrene. Other materials include poly-ethylene, polypropylene, or PTFE (e.g., teflon). In general, the insulating material 24/28 should offer low dielectric losses, high resistivity, and high dielectric constant.

There are a number of ways to attach the insulating material 24/28 to conductor 22/26. First, the materials may be wound together and only fastened on the outside. In a another embodiment, the insulating layer 24/28 can comprise two materials, an insulator and another material which dissolves in the presence of a solvent (such as alcohol). After drying, the dissolved material will stabilize the entire coil 20. Alternatively, the coil 20 may be heated with an electrical current thereby melting the insulator 24/28 and passivating the coil 20. In yet another embodiment, a lacquer coating can be used for the insulating material layers 24 and/or 28.

The integrated inductor and capacitor element 20 can be attached to the transponder chip 12 as illustrated in FIG. 4. In the preferred embodiment, the chip 12 is bonded to the outside of the coil 20. This embodiment is possible if the coil is wider than the chip 12, as is typically (although not necessarily) the case. Standard bond wires may then be used to make the electrical connections. For example, referring to FIG. 2 along with FIG. 4, the HF node can be coupled to the coil 20 via bond wire 40, the VCL node coupled via bond wire 42 and the ground node coupled via bond wire 44. It should be understood that this particular configuration is provided only as an example and the connections could be made otherwise (although it may be preferred to leave the outer foil 22 as ground to create a more stable system). Alternatively, if the substrate of the chip 12 is functionally held at the ground voltage, the electrical connection can be made by using conductive glue (e.g., silver epoxy) from the chip 12 to the conductor 22. This approach would eliminate bond wire 44.

Figure 5:
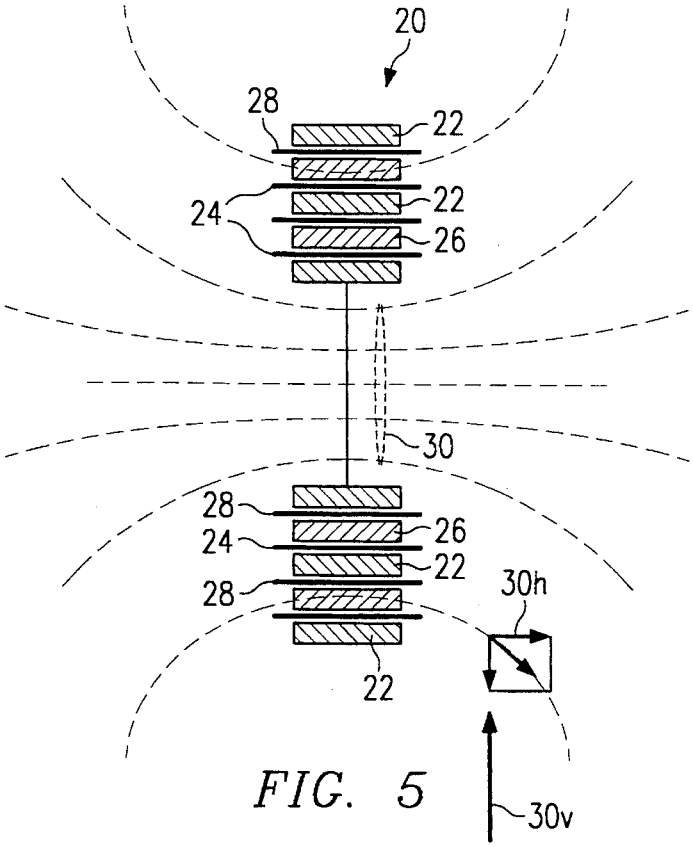
FIG. 5 illustrates a coil device to illustrate the magnetic fields.

FIG. 5 illustrates a cross-sectional view of a coil 20. During operation, a magnetic field will be generated as illustrated by magnetic field lines 30. The vertical component 30*v* of the magnetic field will cause eddy currents 32 in the conductive foil strips 22 and 26 as illustrated in FIG. 6. While the coil will operate with the eddy currents 32, these currents 32 may the limit the Q factor (quality factor) of the coil. In this context, the Q factor is defined as the ratio of the imaginary component to the real component of the impedance.

Figure 7A:
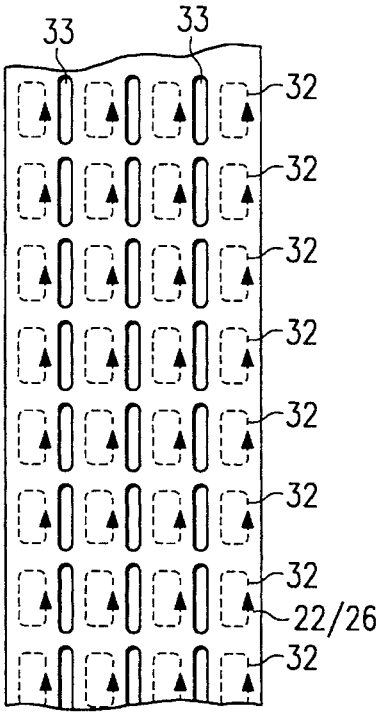
FIGS. 7A–7B illustrate a foil strip which includes slits formed therein to minimize the eddy currents.

A modification to the foil strips 22 and/or 26 which lowers the eddy currents is illustrated in FIG. 7A. In this embodiment, slits 33 are formed in the foil. Since the eddy currents 32 are unable to flow through the slit 33, the magnitude of the current 32 has been effectively reduced. In this manner, the Q of the coil will be desirably raised.

Figure 7B:
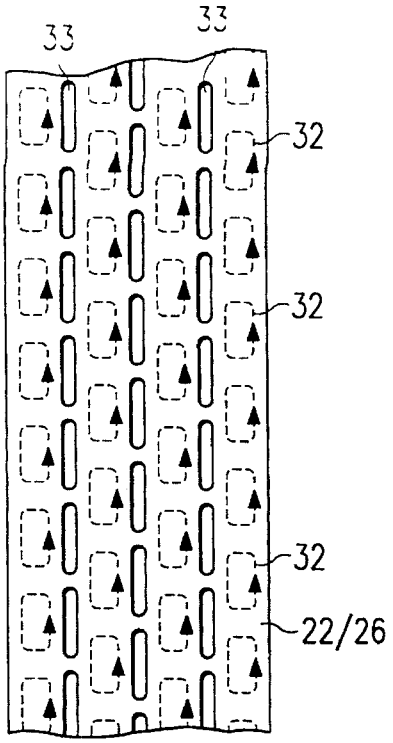
Figure 7C:
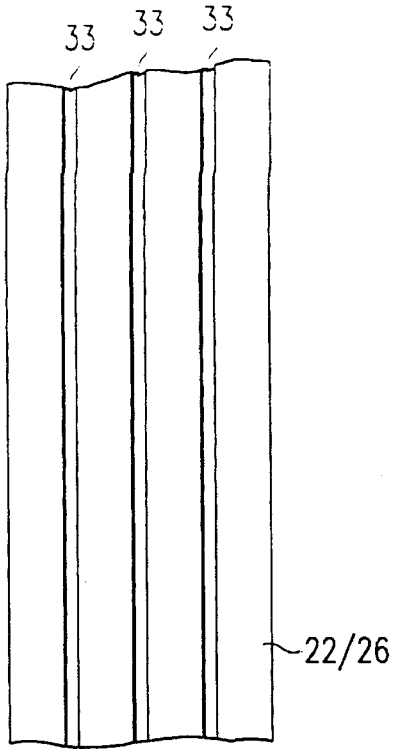

FIGS. 7B and 7C illustrate two alternative foil strips 22/26 which include slits 33. In FIG. 7B, the slits 33 in parallel rows are offset. This embodiment may provide increased flexibility. In FIG. 7C, the slits 33 extend the entire length of foil strip 22/26. The electrical performance will be enhanced as each slit gets longer, and less metal exists between slits within a row. This embodiment, however, may be more difficult to build.

In the illustrated embodiment, the slits 32 are formed in a plurality of substantially parallel rows. While this configuration is not the only one which will help reduce eddy currents, it may be the simplest to implement. It is noted, however, that any arrangement of slits would be desirable to help reduce the eddy currents. In the illustrated embodiment, the substantially parallel rows of slits are disposed parallel to the edge of the foil strip 22/26. In this manner, the parallel rows extend over multiple ones of the windings. Of course, even if they were not disposed in parallel rows, the slits 32 could extend over multiple windings.

Figure 8:
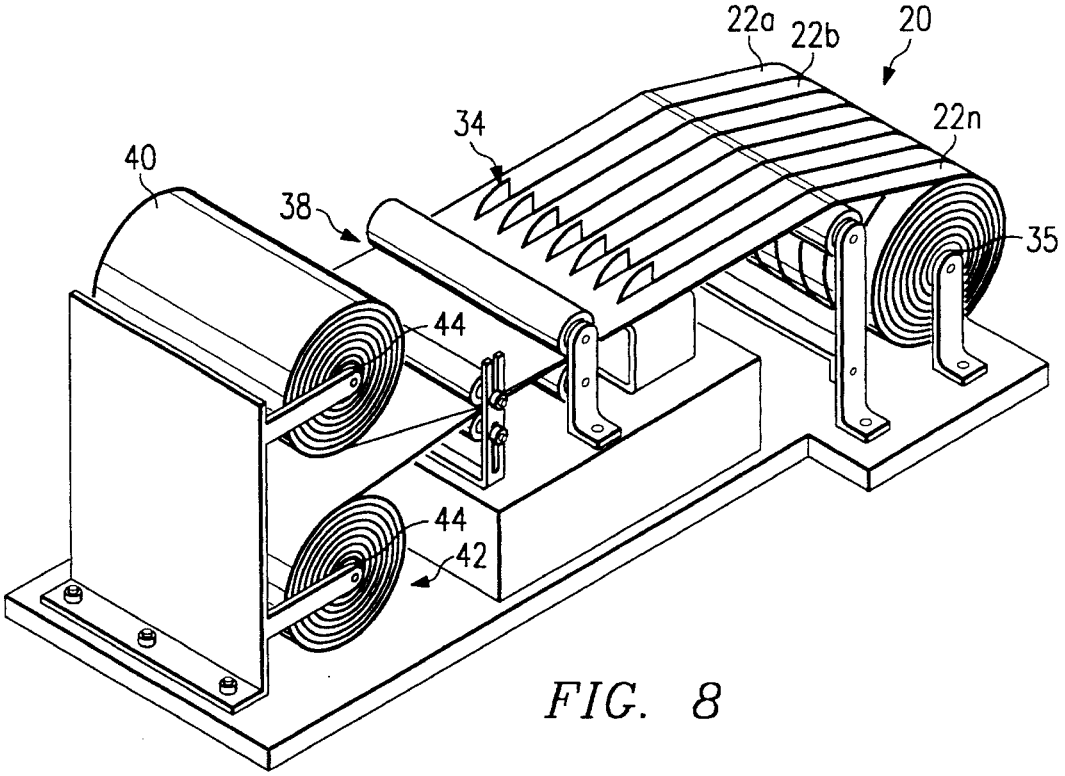
FIGS. 8 and 9 illustrate alternative embodiment apparatus for forming a coil of the present invention.
Figure 9:
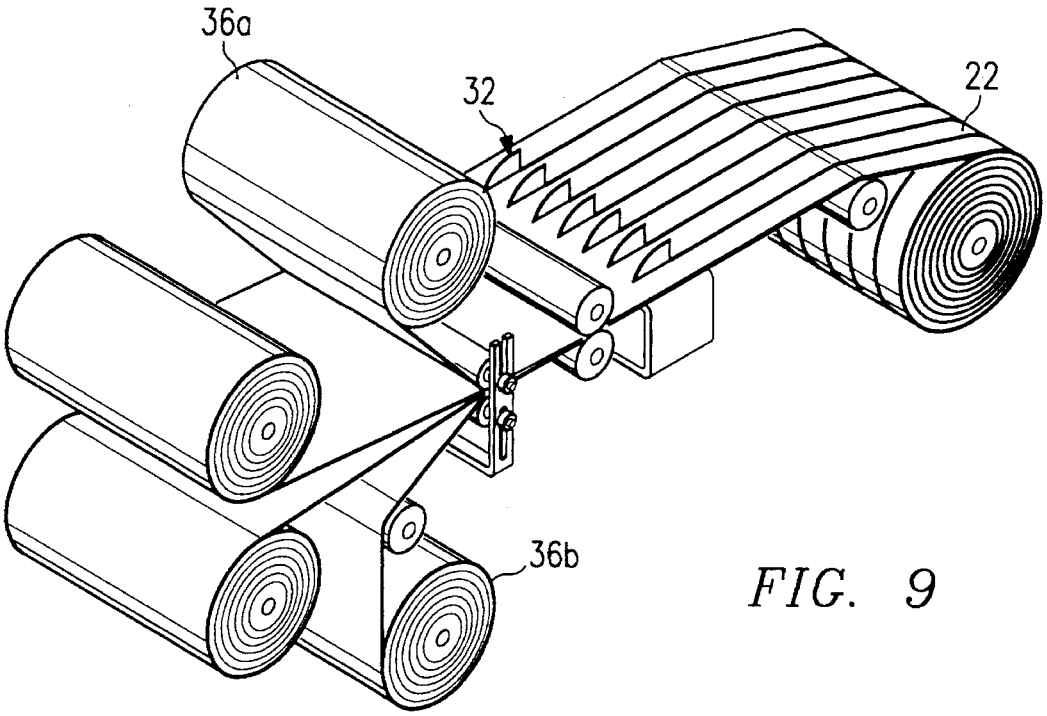

Two methods of producing the integrated coil 20 of the present invention will now be described. Referring now to FIGS. 8 and 9, a first sheet of conductive foil 40 (e.g., aluminum foil) and a second sheet of conductive foil 42 (e.g., aluminum foil) used as base materials. The conductive foil 40 has an insulating material (not shown) disposed thereon. For example, the insulating material may comprise a lacquer which is coated on one side of the conductive material 40/42. In the preferred embodiment the sheet of conductive material 40 is stored on a spool 44.

The two conductive sheets 40 and 42 are compressed at a pinch roller 38 and rolled into each other. The sheets are then cut with cutting device 32 and formed into the coils 20. For example, the cutting device 32 may comprise a row of knives separated from each other at fixed distances which will simultaneously cut the foil 30 into ribbons. Although described here is a row of knives, the cutting device 32 may comprise any and all means for cutting the foil 30 into ribbons 22*a*–22*n*. The cutting devices 32 may comprise hardened steel or a diamond tip material. In general, any material which is sufficiently hard and will not wear out is desirable.

After the cutting process, each ribbon 20 is wound onto take-up spool 35. The ribbon 20 is wound into a spiral coil as described herein above. The insulating material (not shown) will end up between layers of foil thereby electrically insulating each winding from adjacent windings. In this manner, there will not be any electrical shorts in the coil after the winding process has been completed.

In an embodiment where lacquer is used as the insulating material, the coils 20 are then heated. This heating step causes the lacquer to melt slightly thereby passivating the coil 22 into a fixed self-supporting component. Typically, a heating step may be performed between about 120° and 250° C. for between about 5 and 60 seconds. Of course, however, this heating temperature and time will depend upon the lacquer material used.

The coils 20 may then be removed from the take-up spool 35. The wire ends may then be pulled out and soldered to the component (e.g., transponder 12) as described above.

Figure 10A:
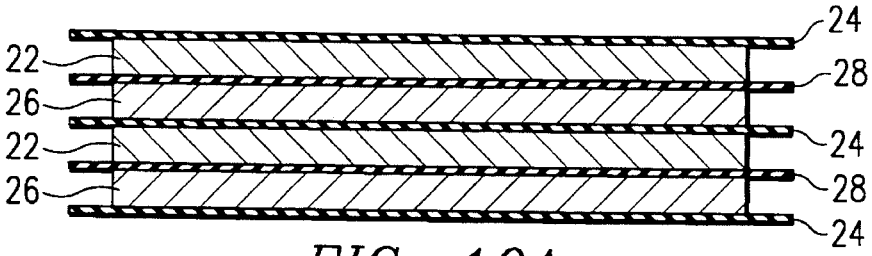
FIGS. 10A and 10B illustrate a passivated coil.
Figure 10B:
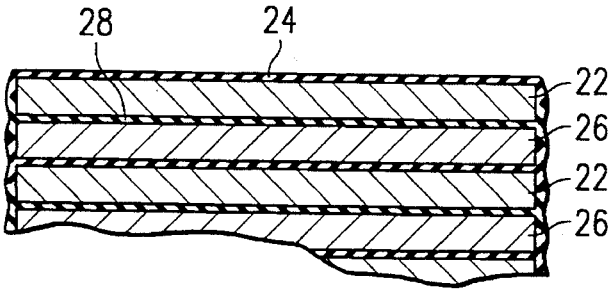

In an alternate method, illustrated in FIG. 10, a sheets of conductive foil 40 and 42 are provided. Rather than providing an insulating coating on the sheets 40 and 42, insulation foil sheets 46 and 48 are present as independent material on separate rolls. The four sheets 40, 42, 46 and 48 are compressed at a pinch roller 38 and rolled into each other. The sheets are then cut with cutting device 32 and formed into the coils 20 as before.

In one embodiment, the insulation ribbons 24 and 28 are cut such that they are wider than the aluminum ribbons 22 and 26. As a result, the insulation strips 24 and 28 will "hang-over" compared to the aluminum sheets 22 and 26. When hot air is blown against the plastic overhang after winding, it will melt on the side, thus passivating the coil 20 to a self supporting structure.

The transponder of the present invention can be used with identification systems in a great variety of applications. The transponder 40 can be attached to or embedded in or simply near an object such as the security badge 40. This object can be almost anything imaginable including tires, baggage, laundry, trash containers, keys, vehicles, or even living animals.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. An integrated inductor and capacitor component comprising:

a first strip of electrically conductive material having a top surface and a bottom surface;

a first insulating material overlying said top surface of said first strip;

a second strip of electrically conductive material having a top surface and a bottom surface;

a second insulating material overlying said top surface of said second strip;

wherein said first and second strips are wound in a coil to form a plurality of windings and such that said first and second insulating materials electrically insulate the top surface of said first strip from the bottom surface of the second strip and the bottom surface of the first strip from the top surface of the second strip such that the first strip is electrically insulated from the second strip.

2. The component of claim 1 wherein said first and second strips of electrically conductive material comprise copper strips.

3. The component of claim 1 wherein said first insulating material comprises a lacquer coating.

4. The component of claim 1 wherein said first insulating material comprises mylar.

5. The component of claim 1 wherein said first insulating material comprises polystyrene.

6. The component of claim 1 wherein said first and second strips each have a plurality of slits formed therein.

7. The component of claim 6 wherein said slits are formed in a plurality of substantially parallel rows.

8. The component of claim 7 wherein said plurality of substantially parallel rows extend over multiple ones of said windings.

9. A method of making a plurality of integrated inductor and capacitor components comprising the steps of:

providing a first sheet of conductive material;

disposing a first insulating material adjacent said first sheet of conductive material;

providing a second sheet of conductive material;

disposing a second insulating material adjacent said second sheet of conductive material;

cutting said first sheet of conductive material and said first insulating material into a first plurality of strips;

cutting said second sheet of conductive material and said second insulating material into a second plurality of strips: and forming a plurality of integrated inductor and capacitor components, each component formed by winding a first strip from said first plurality of strips and a second strip from said second plurality of strips to form a plurality of windings such that said first and second insulating materials electrically insulate each of said windings from adjacent ones of said windings and such that said first strip is electrically isolated from said second strip.

10. The method of claim 9 wherein said step of disposing a first insulating material adjacent said first sheet of said conductive material comprises coating said conductive material with a lacquer.

11. The method of claim 10 and further comprising the step of heating at least one of said integrated inductor and capacitor components such that said lacquer melts thereby passivating the component into a fixed self supporting component.

12. The method of claim 9 wherein said step of disposing a first insulating material adjacent said first sheet of conductive material comprises pressing a sheet of insulating material against said first sheet of conductive material.

13. The method of claim 12 wherein said steps of cutting said first and second sheets of conductive material and said insulating material comprise cutting said insulating material such that strips of said insulating material are wider than strips of said conductive material.

14. The method of claim 13 and further comprising the step of heating said integrated inductor and capacitor component such that said insulating material passivates said integrated inductor and capacitor component.

15. The method of claim 9 wherein said step of providing a first sheet of conductive material comprises providing a sheet of copper.

16. An integrated inductor and capacitor component formed from a method comprising the steps of:

providing a first sheet of conductive material;

disposing a first insulating material adjacent said first sheet of conductive material;

providing a second sheet of conductive material;

disposing a second insulating material adjacent said second sheet of conductive material;

cutting said first and second sheets of conductive material and said first and second insulating materials into a plurality of strips; and winding a strip of said first conductive material and a strip of said second conductive material in a coil to form a plurality of windings such that said first and second insulating materials electrically insulate each of said windings from adjacent ones of said windings.

17. An identification system comprising:

an interrogation unit for communicating with cooperating transponder units, said interrogation unit comprising: control circuitry;

a transmitter for transmission of at least one interrogation signal, said transmitter coupled to said control circuitry; and a receiver for receiving signal information at the termination of said at least one interrogation signal, said receiver coupled to said control circuitry; and a transponder unit located in spaced relation with respect to said interrogation unit for receiving said interrogation signal and returning signal information to said receiver, said transponder unit including:

at least one electrical circuit component;

a parallel resonant circuit including a coil and a capacitor coupled to said at least one electrical circuit component; and an energy accumulator coupled to said parallel resonant circuit;

wherein said energy accumulator and said coil of said parallel resonant circuit comprise an integrated component, said integrated component comprising first and second strips of electrically conductive material wound in a coil to form a plurality of windings and such that an insulating material electrically insulates each of said windings from adjacent ones of said windings.

18. The system of claim 17 wherein said at least one electrical circuit component comprises:

a carrier wave generator for providing a FSK modulated carrier wave having at least two frequencies including a first frequency contained in said interrogation signal and a second frequency selectively shifted from said first frequency;

circuitry operably connected to the output of said carrier wave generator for producing control signals for maintaining and modulating said carrier wave;

circuitry for transmitting the FSK modulated carrier wave and data from said transponder unit back to said interrogation unit as said signal information; and circuitry for initiating operation of said carrier wave generator in response to the detected power level of the interrogation signal decreasing and also in response to the presence of a predetermined energy amount stored in said energy accumulator.

* * * * *